US006306287B1

(12) United States Patent
Billon et al.

(10) Patent No.: US 6,306,287 B1
(45) Date of Patent: Oct. 23, 2001

(54) PROCESS FOR HYDROTREATMENT OF A HEAVY HYDROCARBON FRACTION USING PERMUTABLE REACTORS AND INTRODUCTION OF A MIDDLE DISTILLATE

(75) Inventors: Alain Billon, Le Vesinet; Frédéric Morel, Francheveville; Stéphane Kressmann, Serezin du Rhone, all of (FR); Sun Dong Kim, Seoul (KR); Sung Ki Ha, Kyoungsangnam-do (KR); Haen Heor, Kyungki-do (KR)

(73) Assignee: Institut Francais du Petrole, Rueil-Malmaison (FR)

( * ) Notice: Subject to any disclaimer, the term of this patent is extended or adjusted under 35 U.S.C. 154(b) by 0 days.

(21) Appl. No.: 09/417,766

(22) Filed: Oct. 14, 1999

(30) Foreign Application Priority Data

Oct. 14, 1998 (FR) ..... 98 12913

(51) Int. Cl.[7] ..... C10G 65/02; C10G 65/04

(52) U.S. Cl. ..... 208/211; 208/210; 208/212; 208/251 H

(58) Field of Search ..... 208/210, 211, 208/212, 251 H

(56) References Cited

U.S. PATENT DOCUMENTS

| | | | | |
|---|---|---|---|---|
| 4,118,310 | * | 10/1978 | Frayer et al. | 208/210 |
| 4,619,759 | | 10/1986 | Myers et al. | 208/210 |
| 4,925,554 | * | 5/1990 | Sato et al. | 208/210 |
| 5,417,846 | * | 5/1995 | Renard | 208/210 |

FOREIGN PATENT DOCUMENTS 2 681 871 4/1993 (FR) .

* cited by examiner

*Primary Examiner*—Walter D. Griffin
(74) *Attorney, Agent, or Firm*—Millen, White, Zelano & Branigan, P.C.

(57) ABSTRACT

A hydrotreatment process is carried out in at least two steps to hydrotreat a heavy hydrocarbon fraction containing asphaltenes, sulphur-containing impurities and metallic impurities, comprising a first hydrodemetallization step and a subsequent second hydrodesulphurization step, in which the hydrodemetallization step comprises one or more hydrodemetallization zones with fixed beds preceded by at least two hydrodemetallization guard zones (A) and (B), also with fixed beds, disposed in series for cyclic use consisting of successive repetition of steps b) and c) defined below. The process comprises the following steps: a) a step in which the guard zones are used together for a period of at most equal to the deactivation time and/or clogging time of one thereof, b) a step during which the deactivated and/or clogged guard zone is short-circuited and the catalyst it contains is regenerated and/or replaced by fresh catalyst, and c) a step during which the guard zones (A) and (B) are used together, the guard zone where the catalyst has been regenerated during the preceding step being reconnected and said step being carried out for a period at most equal to the deactivation and/or clogging time of one of the guard zones. The process is characterized by introducing a quantity of middle distillate, particularly a gas oil, with the feed representing 0.5% to 80% by weight with respect to the feed. The process can comprise a prior hydrovisbreaking step and optionally a final deasphalting step using a solvent.

15 Claims, 3 Drawing Sheets

Figure 1:
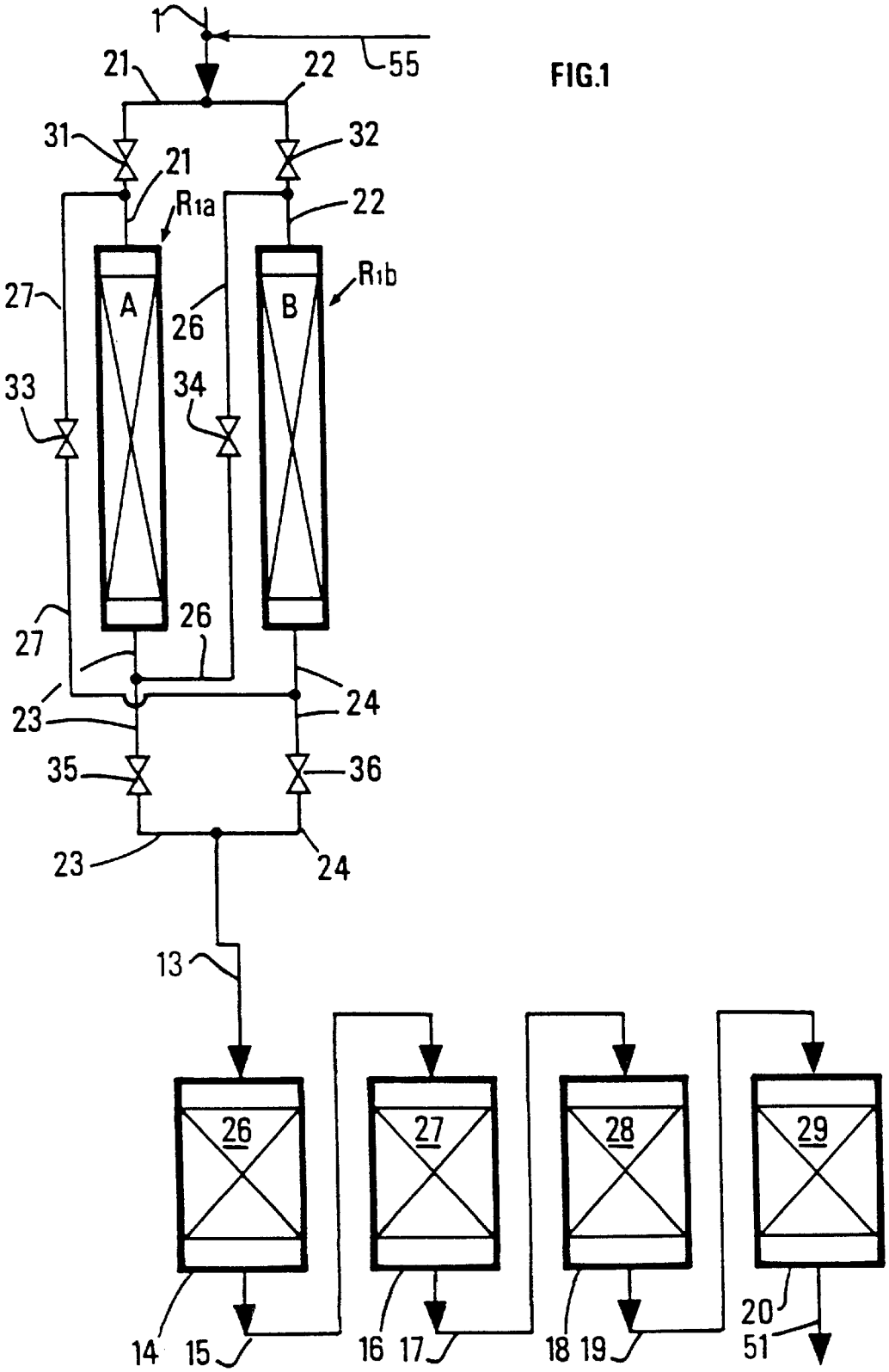

1
21
22
55
31
32
21
22
R1a
R1b
27
A
26
B
54
33
34
56
52
51
D1
27
26
23
24
53
35
36
23
24
13
26
27
28
29
14
15
16
17
18
19
20
51

1
21
42
31
22
41
32
27
R1a
R1b
R1c
55
54
A
B
C
34
44
33
56
52
51
D1
26
46
43
53
23
24
48
35
36
13
26
27
28
29
14
15
16
17
18
19
20
51

PROCESS FOR HYDROTREATMENT OF A HEAVY HYDROCARBON FRACTION USING PERMUTABLE REACTORS AND INTRODUCTION OF A MIDDLE DISTILLATE

The present invention relates to refining and converting heavy hydrocarbon fractions containing, inter alia, asphaltenes, and sulphur-containing and metallic impurities, such as atmospheric residues, vacuum residues, deasphalted oils, pitches, asphalts mixed with an aromatic distillate, coal hydrogenates, heavy oils of any origin and in particular those from bituminous schists or sands. In particular, it relates to treating liquid feeds.

Feeds which can be treated in accordance with the invention normally comprise at least 100 ppm by weight of metals (nickel and/or vanadium), at least 1% by weight of sulphur, and at least 2% by weight of asphaltenes.

The aim of catalytic hydrotreatment of such feeds is both to refine, i.e., to substantially reduce their asphaltene, metal, sulphur and other impurity contents while increasing the hydrogen-to-carbon ratio (H/C) while transforming them to a greater or lesser extent to lighter cuts, the different effluents obtained possibly serving as bases for the production of high quality fuel, gas oil and gasoline, or feeds for other units such as residue cracking.

The problem with catalytic hydrotreatment of such feeds originates from the fact that such impurities gradually deposit themselves on the catalyst in the form of metals and coke, and tend to rapidly deactivate and clog the catalytic system, which necessitates a stoppage to replace it.

Processes for hydrotreating that type of feed must therefore be designed to allow as long as possible a cycle of operation without stopping the unit, the aim being to attain a minimum one year cycle of operation, namely a minimum of eleven months of continuous operation plus one month stoppage maximum to replace the entire catalytic system.

A variety of treatments for this type of feed exist. Such treatments have until now been carried out:

- either in processes using fixed catalyst beds (for example the HYVAHL-F process from the Institute Français du Pétrole);
- or in processes comprising at least one reactor enabling the catalyst to be replaced quasi-continuously (for example the HYVAHL-M moving bed process from the Institut Français du Pétrole).

The process of the present invention is an improvement over fixed catalyst bed processes. In such processes, the feed circulates through a plurality of fixed bed reactors disposed in series, the first reactor or reactors being used to carry out hydrodemetallisation (HDM) of the feed in particular and part of the hydrodesulphurisation, the final reactor or reactors being used to carry out deep refining of the feed, and in particular hydrodesulphurisation (HDS step). The effluents are withdrawn from the last HDS reactor.

In such processes, specific catalysts adapted to each step are usually used, under average operating conditions of about 150 to 200 bars pressure and a temperature of about 370° C. to 420° C.

For the HDM step, the ideal catalyst must be suitable for treating feeds which are rich in asphaltenes, while having a high demetallisation capacity associated with a high metal retention capacity and a high resistance to coking. The Assignee of the present invention, Institut Francais du Petrole has developed such a catalyst on a particular macroporous support (the "sea urchin" structure) which endows it with precisely the desired qualities for this step (European patents EP-B-0 113 297 and EP-B-0 113 284):

- a degree of demetallisation of at least 80% to 90% in the HDM step;
- a metal retention capacity of more than 60% with respect to the weight of new catalyst, which results in longer cycles of operation;
- high resistance to coking even at temperatures of more than 400° C. which contributes to extending the cycle period which is often limited by increasing the pressure drop and the activity loss due to coke production, and which means that the majority of the thermal conversion can be carried out in this step.

For the HDS step, the ideal catalyst must have a high hydrogenating power so as to carry out deep refining of the products: desulphurisation, continuation of demetallisation, reducing the Conradson carbon and the amount of asphaltenes. The Assignee has developed such a catalyst (EP-B-0 113 297 and EP-B-0 113 284) which is particularly suitable for treating that type of feed.

The disadvantage of that type of high hydrogenating capacity catalyst is that it rapidly deactivates in the presence of metals or coke. For this reason, combining a suitable HDM catalyst, which can function at a relatively high temperature to carry out most of the conversion and demetallisation, with a suitable HDS catalyst, which can be operated at a relatively low temperatures as it is protected from metals and other impurities by the HDM catalyst which encourages deep hydrogenation and limits coking, then in the end overall refining performances are obtained which are higher than those obtained with a single catalytic system or with those obtained with a similar HDM/HDS arrangement using an increasing temperature profile which leads to rapid coking of the HDS catalyst.

The importance of fixed bed processes is that high refining performances are obtained because of the high catalytic efficacy of fixed beds. In contrast, above a certain quantity of metals in the feed (for example 100 to 150 ppm), even though better catalytic systems are used, the performance and especially the operating period for such processes becomes insufficient: the reactors (in particular the first HDM reactor) rapidly become charged with metals and thus deactivate; to compensate for that deactivation, the temperatures are increased, which encourages coke formation and increases pressure drops; further, it is known that the first catalytic bed is susceptible to becoming clogged quite rapidly because of the asphaltenes and sediments contained in the feed or as a result of operating problems.

The result is that the unit has to be stopped a minimum of every 3 to 6 months to replace the first deactivated or clogged catalytic beds, that operation possibly lasting up to three weeks and which further reduces the service factor of the unit.

Different attempts have been made to overcome the disadvantages of fixed bed arrangements.

Thus, one or more moving bed reactors have been proposed, installed at the head of the HDM step (U.S. Pat. No. 3,910,834 or British patent GB-B-2 124 252). Such moving beds can operate in co-current mode (the HYCON process from SHELL, for example) or in counter-current mode (the Applicant's HYVAHL-M process, for example). This protects the fixed bed reactors by carrying out part of the demetallisation and filtering the particles contained in the feed which could lead to clogging. Further, quasi-continuous replacement of the catalyst in that or those moving bed reactors avoids the need to stop the unit every 3 to 6 months.

The disadvantage of such moving bed techniques is that in the end, their performances and efficiency are rather inferior to those for fixed beds of the same size, that they cause attrition of the circulating catalyst which can lead to obstruction of the fixed beds located downstream, and which above all, under the operating conditions used, the risks of coking and thus the formation of agglomerates of catalyst are far from negligible with such heavy feeds, in particular in the event of problems, which can prevent the catalyst from circulating either in the reactor or in the used catalyst withdrawal lines, and finally cause stoppage of the unit to clean the reactor and the withdrawal lines.

In order to retain the excellent performance of fixed beds while maintaining an acceptable service factor, the addition of a fixed bed guard reactor (space velocity HSV=2 to 4) in front of the HDM reactors has been considered (U.S. Pat. No. 4,118,310 and U.S. Pat. No. 3,968,026). Usually, this guard reactor can be short-circuited by using an isolation valve in particular. Thus the principal reactors are temporarily protected against clogging. When the guard reactor is clogged it is short-circuited, but then the following principal reactor can become clogged in its turn and lead to stoppage of the unit. Further, the small size of the guard reactor does not ensure a high degree of demetallisation of the feed and thus is a poor protector of the principal HDM reactors against the deposition of metals in the case of metal-rich feeds (more than 150 ppm). Thus those reactors undergo accelerated deactivation leading to too frequent stoppages of the unit and thus to service factors which are still insufficient.

The Assignee in particular has already described a system which can combine high performances of the fixed bed in French patent FR-B1-2 681 871 with a high service factor for the treatment of feeds with a high metal content (50 to 1500 ppm but usually 100 to 1000 and preferably 100 to 350 ppm) which consists in a hydrotreatment process carried out in at least two steps to hydrotreat a heavy hydrocarbon fraction containing asphaltenes, sulphur-containing impurities and metallic impurities in which during the first step, hydrodemetallisation, the hydrocarbon feed and hydrogen are passed over a hydrodemetallisation catalyst under hydrodemetallisation conditions then during the subsequent second step, the effluent from the first step is passed over a hydrodesulphurisation catalyst under hydrodesulphurisation conditions, in which the hydrodemetallisation step comprises one or more hydrodemetallisation zones with fixed beds preceded by at least two hydrodemetallisation guard zones also with fixed beds, disposed in series for cyclic use consisting of successive repetition of steps b) and c) defined below:

a) a step in which the guard zones are used together for a period at most equal to the deactivation time and/or clogging time for one thereof;

b) a step during which the deactivated and/or clogged guard zone is short-circuited and the catalyst it contains is regenerated and/or replaced by fresh catalyst; and c) a step during which the guard zones are all used together, the guard zone where the catalyst has been regenerated during the preceding step being reconnected and said step being carried out for a period at most equal to the deactivation and/or clogging time for one of the guard zones.

This process produces a cycle period which is in general at least 11 months for the principal HDM and HDS reactors with high performances for refining and conversion while retaining the stability of the products. The overall desulphurisation is of the order of 90% and the overall demetallisation is of the order of 95%. However, there is some difficulty associated with the high viscosity of the feed and the total liquid effluent which causes high pressure drops in the reactor and difficulties in the operation of the recycling compressor, often resulting in a rather low hydrogen pressure which does not encourage either good hydrodemetallisation or good hydrodesulphurisation. Further, it has been shown that the gas oil fraction obtained normally cannot directly be used as its sulphur content is higher than current specifications allow.

We have now, surprisingly, discovered that it is possible to improve the performances of a process such as that described by the Assignee in French patent FR-B 1-2 681 871. In particular, the process of the present invention can very substantially reduce the viscosity of the liquid effluents, resulting in a substantial reduction in the pressure drops in the reactors, better operation of the recycling compressor and the production of a higher hydrogen pressure. This results in higher overall desulphurisation and a gas oil fraction with a much lower sulphur content, satisfying the current specifications and which can be directly used in the gas oil pool of the refinery. Further, it has also been shown that when carrying out the process of the present invention, the preheat furnaces function better because of better heat transfer and thus the skin temperature of these furnaces is lower which helps to increase the service life of the furnaces and thus contributes to reducing the operating costs of the unit. It has also been shown that, in contrast to adding a heavier fraction such as light recycled gas oil fractions from catalytic cracking and usually termed LCO, Light Cycle Oil, by the skilled person, with an initial boiling point which is normally about 180° C. to 220° C. and an end point of about 340° C. to about 380° C., or heavy recycled gas oil fractions from catalytic cracking, usually termed HCO, High Cycle Oil, by the skilled person, with an initial boiling point of about 340° C. to about 380° C. and an end point of about 350° C to about 550° C., no supplemental exothermicity is introduced into the principal HDM and HDS reactors. The LCO cut is a cut which is fairly close to gas oil cuts but with a very low cetane number and high aromatic compound, sulphur and nitrogen contents. The HCO cut is a heavier cut than typical gas oil fractions and is heavier than the LCO cut with very high aromatic compound, sulphur and nitrogen contents.

The process of the invention, which combines high fixed bed performances with a high service factor for treating feeds with high metal contents (50 to 1500 ppm, but usually 100 to 1000 and preferably 100 to 350 ppm) can be defined as a process for hydrotreating a heavy hydrocarbon fraction containing asphaltenes, sulphur-containing impurities and metallic impurities in at least two steps, in which during the first step, hydrodemetallisation, the hydrocarbon feed and hydrogen are passed over a hydrodemetallisation catalyst under hydrodemetallisation conditions then during the subsequent second step, the effluent from the first step is passed over a hydrodesulphurisation catalyst under hydrodesulphurisation conditions, in which the hydrodemetallisation step comprises one or more hydrodemetallisation zones with fixed beds preceded by at least two hydrodemetallisation guard zones also with fixed beds, disposed in series for cyclic use consisting of successive repetition of steps b) and c) defined below:

a) a step in which the guard zones are used together for a period of at most equal to the deactivation time and/or clogging time for one thereof;

b) a step during which the deactivated and/or clogged guard zone is short-circuited and the catalyst it contains is regenerated and/or replaced by fresh catalyst; and c) a step during which the guard zones are all used together, the guard zone where the catalyst has been regenerated during the preceding step being reconnected and said step being carried out for a period at most equal to the deactivation and/or clogging time for one of the guard zones; said process being characterized in that a quantity of middle distillate representing 0.5% to 80% by weight with respect to the weight of the hydrocarbon feed is introduced into the inlet to the first functioning guard zone at the same time as the feed.

Often, the quantity of middle distillate introduced represents about 1% to about 5% and usually about 5% to about 25% by weight with respect to the weight of hydrocarbon feed.

In a particular implementation, the atmospheric distillate which is introduced with the hydrocarbon feed is a straight run gas oil.

In a further implementation, the product from the hydrodesulphurisation step is sent to an atmospheric distillation zone from which an atmospheric distillate is recovered at least a portion of which is recycled to the inlet to the first functioning guard zone, and an atmospheric residue is recovered.

In a particular variation, at least a portion of a gas oil fraction from the atmospheric distillation is recycled. In this case, the gas oil cut which is recycled is usually a cut with an initial boiling point of about 150° C. and with an end point of about 370° C. Usually this cut is a 170–350° C. cut.

The quantity of atmospheric distillate and/or gas oil which is recycled represents about 5% to 25%, usually about 10% to 20% by weight, with respect to the feed.

In a further variation, at least a portion of the atmospheric residue from the atmospheric distillation zone is sent to a vacuum distillation zone from which a vacuum distillate is recovered at least a portion of which is recycled to the inlet to the first functioning guard zone, and a vacuum residue is also recovered which can be sent to the refinery fuel pool.

In a further variation, at least a portion of the atmospheric residue and/or vacuum distillate is sent to a catalytic cracking unit, preferably a fluidised bed catalytic cracking unit, for example a unit such as that using the R2R process developed by the Assignee. From this catalytic cracking unit, an LCO fraction and an HCO fraction in particular are recovered at least part of either one or the other, or a mixture of the two, can be added to the fresh feed which is sent to the hydrotreatment process of the present invention. Usually, a gas oil fraction, a gasoline fraction and a gaseous fraction are also recovered. At least a portion of this gas oil fraction can optionally be recycled to the inlet to the first functioning guard zone.

The catalytic cracking step can be carried out in a conventional manner known to skilled persons under suitable residue cracking conditions to produce hydrocarbon-containing products with a lower molecular weight. Descriptions of the operation and catalysts which can be used in fluidised bed cracking can be found, for example, in U.S. Pat. 4,695,370, EP-B-0 184 517, U.S. Pat. No. 4,959,334, EP-B-0 323 297, U.S. Pat. No. 4,965,232, U.S. Pat. No. 5,120,691, U.S. Pat. No. 5,344,544, U.S. Pat. No. 5,449,496, EP-A-0 485 259, U.S. Pat. No. 5,286,690, U.S. Pat. No. 5,324,696 and EP-A-0 699 224 the descriptions of which are hereby incorporated into the present description by dint of their mention.

The fluidised bed catalytic cracking reactor can function in upflow or downflow mode. While this is not a preferred embodiment of the invention, it is also possible to carry out catalytic cracking in a moving bed reactor. Particularly preferred catalytic cracking catalysts are those which contain at least one zeolite usually mixed with an appropriate matrix such as alumina, silica or silica-alumina.

The process of the invention includes a particular variation in which during step c) the guard zones are used all together, the guard zone where the catalyst has been regenerated during step b) being reconnected such that its connection is identical to that which it had before it was short-circuited during step b).

The process of the invention comprises a further variation, which constitutes a preferred implementation of the present invention, comprising the following steps:

a) a step in which the guard zones are all used together for a period at least equal to the deactivation and/or clogging time of the most upstream the guard zone with respect to the overall direction of circulation of the treated feed;

b) a step during which the feed penetrates directly into the guard zone located immediately after that which was the most upstream during the preceding step and during which the guard zone which was the most upstream during the preceding step is short-circuited and the catalyst which it contains is regenerated and/or replaced by fresh catalyst; and c) a step during which the guard zones are used all together, the guard zone in which the catalyst has been regenerated and/or replaced during the preceding step being reconnected so as to be downstream of the set of guard zones and said step being continued for a period at most equal to the deactivation and/or clogging time of the guard zone which during this step is the most upstream with respect to the overall direction of circulation of the treated feed.

In the preferred implementation of the process, the guard zone which is the most upstream in the overall direction of circulation of the feed gradually becomes charged with metals, coke, sediments and a variety of other impurities and is disconnected when desired but usually when the catalyst it contains is practically saturated with metals and various impurities.

In a preferred implementation, a particular conditioning section is used which permits permutation of these guard zones during operation, i.e., without stopping the unit's operation: firstly, a system which operates under moderate pressure (10 to 50 bars but preferably 15 to 25 bars) carries out the following operations on the disconnected guard reactor: washing, stripping, cooling, before discharging the used catalyst; then heating and sulphurisation after loading with fresh catalyst; then a further pressurisation/depressurisation and tap/valve system using appropriate technology effectively interchanges these guard zones without stopping the unit, i.e., without affecting the service factor, since all of the washing, stripping, discharging of used catalyst, reloading of fresh catalyst, heating, sulphurisation operations are carried out on the disconnected reactor or guard zone.

The reactors of the hydrotreatment unit usually function with the following hourly space velocities (HSV):

| | HSV ($h^{-1}$) Wide range | HSV ($h^{-1}$) Preferred range |
|---|---|---|
| Total HDM step: (including guard reactors) | 0.2–0.5 | 0.3–0.4 |
| Total HDS step: | 0.2–0.5 | 0.25–0.4 |
| Overall (HDM + HDS): | 0.10–0.50 | 0.12–0.30 |

The preferred characteristic here consists of operating the guard reactors or zones in service at an overall HSV of about 0.1 to 2.0, usually about 0.2 to 1.0, which differs from other processes using smaller guard reactors, in particular as described in U.S. Pat. No. 3,968,026 where smaller guard reactors are used. The value of the HSV of each functioning guard reactor is preferably about 0.5 to 4 and usually about 1 to 2. The overall HSV of the guard reactors and that of each reactor is selected so as to carry out maximum HDM while controlling the reaction temperature (limiting the exothermicity).

In a preferred implementation of the process, the volume of each of the reactors in said guard zones is substantially the same as that of each of the reactors in the hydrodemetallisation zone or zones.

It has been observed that using suitable HDM/HDS catalysts, preferably the Assignee's own (EP-B-0 113 297 and EP-B-0 113 284) and the features of the invention described above, one would obtain:

- 50% and more HDM of the feed at the outlet from the guard reactors (and more precisely 50% to 92% HDM) due to the selected HSV and the efficacy of the HDM catalyst, in contrast to prior art techniques which could not exceed about 35% HDM in the guard reactor. Further, because of the high metal retention capacity of this catalyst (more than 60% by weight of metals deposited with respect to the weight of new catalyst) the average permutation frequency for the guard reactors (depending on the metal content of the feed) is, for example, about 0.5 to about 0.8 months for feeds where the metals content is over about 1000 ppm by weight and about 1 to 6 months and more particularly about 3 to 4 months for feeds with a metal content of about 100 to about 600 ppm by weight. The average permutation frequency is the average period over the ensemble of the period of one operating cycle before it is necessary to disconnect the most upstream functioning guard reactor containing used catalyst, to replace it by the following guard reactor containing a catalyst which is not yet saturated with metals or various impurities.
- one operating cycle period is usually at least 11 months for the principal HDM and HDS reactors due to the excellent protection thereof provided by the guard reactors against metals (more than 50% HDM) and against the problems of clogging by sediments, coke and other impurities.

At the end of this cycle of at least 11 months, also obtained with feeds with a high or very high metals content (100 to 1500 ppm, preferably 150 to 1400 ppm), the unit must be stopped to carry out complete replacement of the catalyst contained in the principal reactors. This operation can be carried out without problems in less than one month, so by operating in this manner, a service factor of at least 0.92 (i.e., 11 months out of 12), substantially superior to the service factor for prior art processes and at least equivalent to processes comprising one or more moving beds, can be obtained. Further, in particular in the case of hydrotreatment of a feed with a very high metals content, for example more than 500 ppm, the use of at least 3 and usually at least 4 guard reactors in series protects it from incidents which can severely affect the most upstream functioning guard reactor (for example coking after a line problem, or clogging after accidental entrainment of salts or sediments in the feed) and thus contributes to maintaining a high service factor.

Maintaining high refining performances throughout the cycle and conversions while retaining product stability:

at least 90% of overall HDS;

at least 95% of overall HDM.

Figure 2:
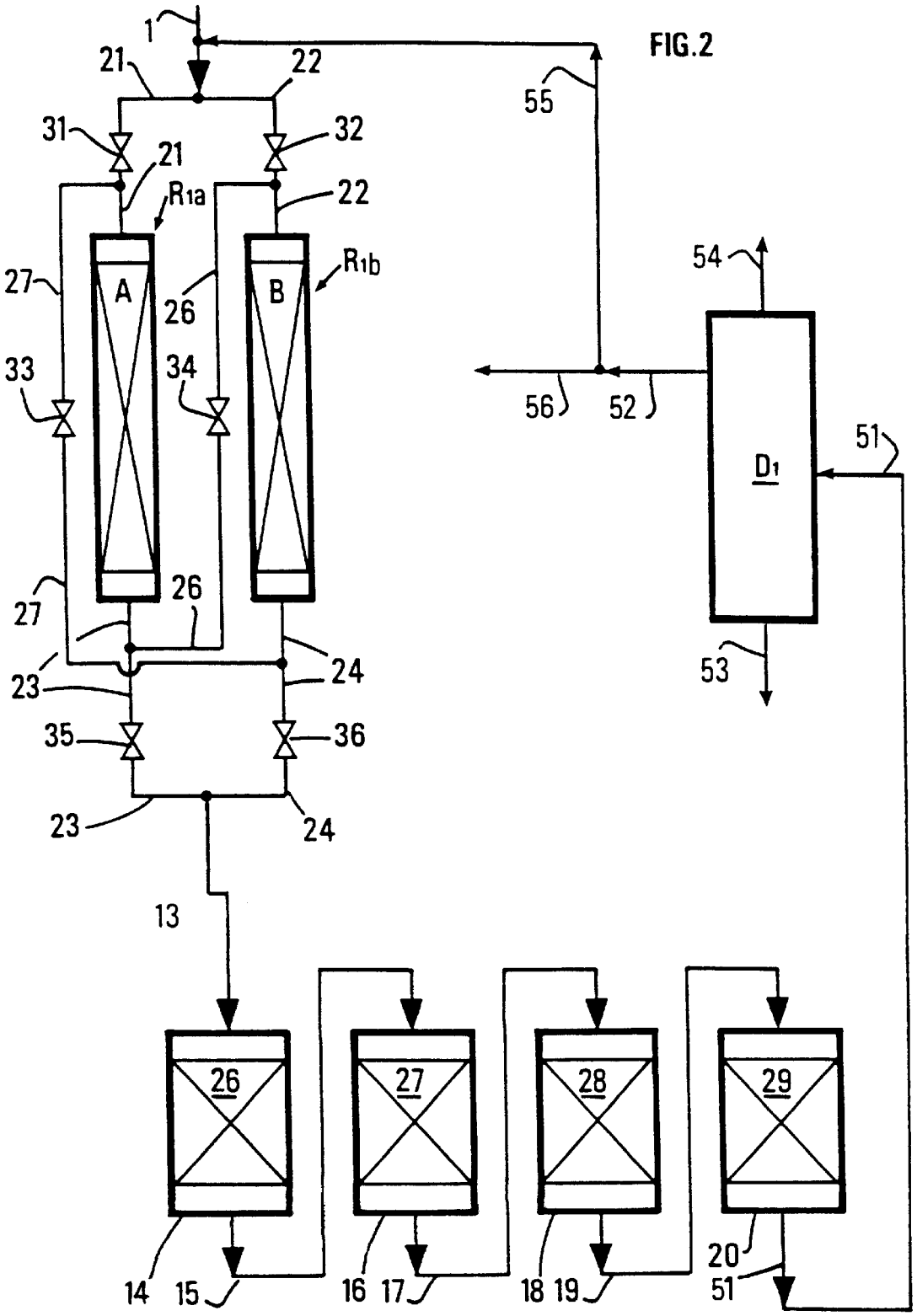
Figure 3:
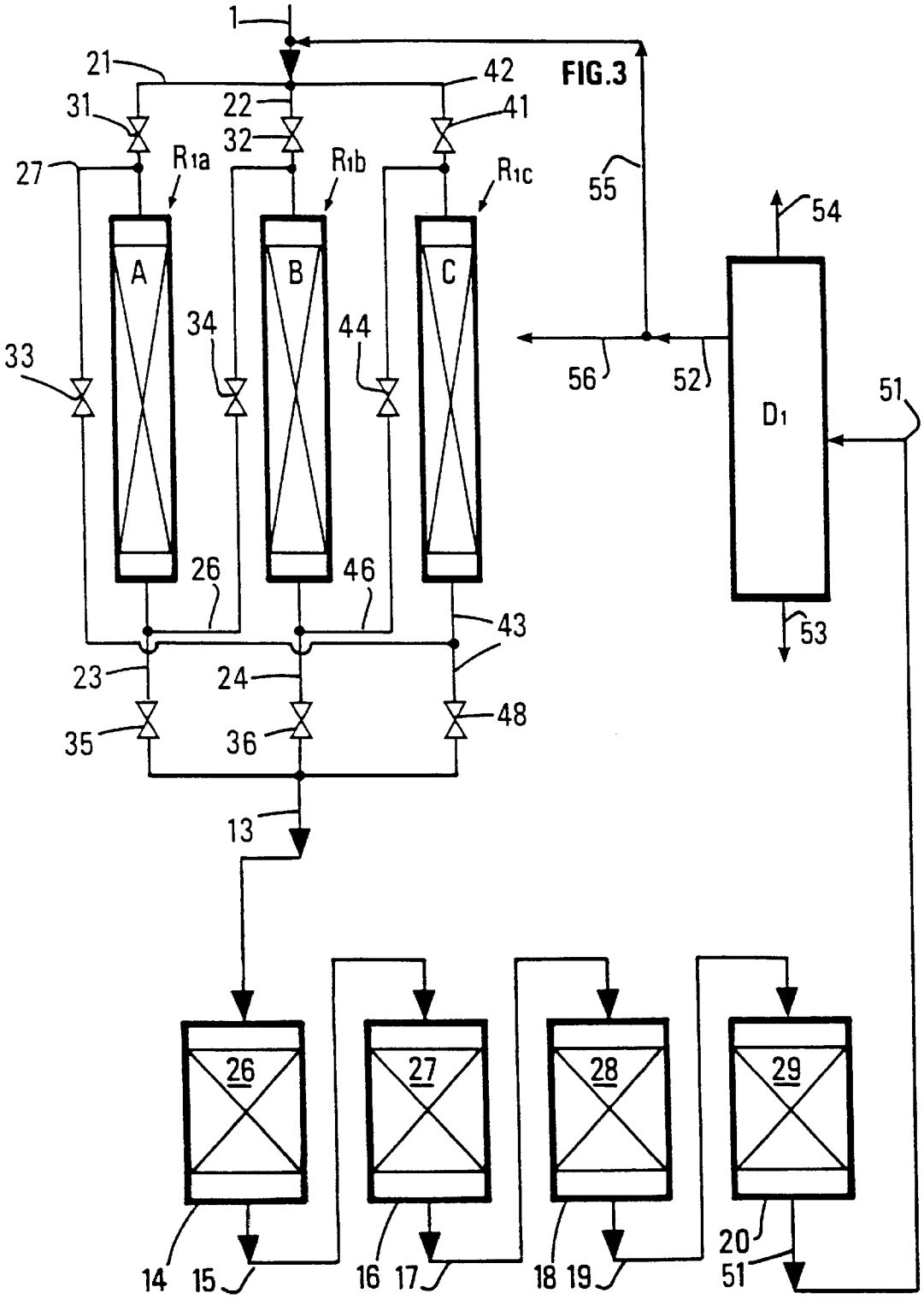

FIGS. 1, 2 and 3 briefly explain the invention by way of illustration. FIGS. 1 and 2 represent the case of using two guard reactors and FIG. 3 shows the use of three guard reactors. The feed arrives in the guard reactor or reactors via line 1 and leaves this or these reactors via line 13. The feed leaving the guard reactor or reactors arrives via line 13 at principal HDM reactor 14 which contains a fixed bed 26 of catalyst. The effluent from reactor 14 is withdrawn via line 15, then sent to a further hydrodemetallisation reactor 16 where it traverses a fixed bed of catalyst 27. The effluent from reactor 16 is withdrawn via line 17 and penetrates into the first hydrodesulphurisation reactor 18 where it traverses a fixed bed 28 of catalyst. The effluent from the first hydrodesulphurisation reactor 18 circulates via line 19 to the second hydrodesulphurisation reactor 20 where it traverses the fixed catalyst bed 29. The final effluent is withdrawn via line 51. In the illustration in FIG. 1, a middle distillate is introduced via line 55 which mixes with the hydrocarbon feed in line 1.

In the illustration in FIG. 2, the final effluent is withdrawn via line 51 then sent to the atmospheric distillation zone D1 in which an atmospheric residue is separated via line 53, an atmospheric gas oil is separated via line 52 and a lighter fraction is separated via line 54. A portion of the atmospheric gas oil is recovered via line 56 and a further portion is recycled via line 55 to the most upstream guard reactor in service.

In the case shown in FIGS. 1 and 2 where the guard zone comprises 2 reactors, the process, in its preferred implementation, will comprise a series of cycles each comprising four successive periods:

- a first period during which the feed successively traverses reactor R1*a* then reactor R1*b* and in which the gas oil fraction from atmospheric distillation which is recycled is introduced with the feed into reactor R1*a;*
- a second period during which the feed traverses only reactor R1*b* and in which the gas oil fraction from atmospheric distillation which is recycled is introduced with the feed into reactor R1*b;*
- a third period during which the feed successively traverses reactor R1*b* then reactor R1*a* and in which the gas oil fraction from atmospheric distillation which is recycled is introduced into reactor R1*b* with the feed;
- a fourth period during which the feed only traverses reactor R1*a* and in which the gas oil fraction from the atmospheric distillation which is recycled is introduced into reactor R1*a* with the feed. The number of cycles carried out for the guard reactor is a function of the period of the operating cycle of the ensemble of the unit and the average frequency of permutation of reactors R1*a* and R1*b*.

During the first period [step a) of the process], the feed is introduced via line 1 and line 21 comprising a valve 31 open towards the guard reactor R1*a* comprising a fixed bed A of catalyst. During this period, the valves 32, 33 and 35 are closed. The effluent from reactor R1*a* is sent via a line 23, line 26, comprising an open valve 34 and line 22 in guard reactor R1*b* comprising a fixed bed B of catalyst. The effluent from reactor R1*b* is sent via line 24, comprising an open valve 36, and line 13 to principal HDM reactor 14.

During the second period [step b) of the process], valves 31, 33, 34 and 35 are closed and the feed is introduced via line 1 and line 22, comprising an open valve 32, towards reactor R1*b*. During this period the effluent from reactor R1*b* is sent via line 24 comprising an open valve 36 and line 13 to principal HDM reactor 14.

During the third period [step c) of the process], valves 31, 34 and 36 are closed and valves 32, 33 and 35 are open. The feed is introduced via line 1 and line 22 to reactor R1*b*. The effluent from reactor R1*b* is sent via line 24, line 27 and line 21 to guard reactor R1*a*. The effluent from reactor R1*a* is sent via line 23 and line 13 to principal HDM reactor 14.

During the fourth period [step d) of the process], valves 32, 33, 34 and 36 are closed and valves 31 and 35 are open. The feed is introduced via line 1 and line 21 to reactor R1*a*. During this period effluent from reactor R1*a* is sent via line 23 and line 13 to principal HDM reactor 14.

In the case shown in FIG. 3, where the guard zone comprises 3 reactors, in the preferred implementation the process comprises a series of cycles each comprising six successive periods:

- a first period during which the feed successively traverses reactor R1*a* then reactor R1*b* and finally reactor R1*c* and in which the gas oil fraction from the atmospheric distillation which is recycled is introduced into reactor R1*a* with the feed;
- a second period during which the feed successively traverses reactor RIb then reactor R1*c* and in which the gas oil fraction from the atmospheric distillation which is recycled is introduced into reactor R1*b* with the feed;
- a third period during which the feed successively traverses reactor R1*b* then reactor R1*c* and finally reactor R1*a* and in which the gas oil fraction from atmospheric distillation which is recycled is introduced into reactor R1*b* with the feed;
- a fourth period in which the feed successively traverses reactor Rlc then reactor R1*a* and in which the gas oil fraction from the atmospheric distillation which is recycled is introduced into reactor R1*c* with the feed;
- a fifth period during which the feed successively traverses reactor R1*c* then reactor R1*a* and finally R1*b* and in which the gas oil fraction from atmospheric distillation which is recycled is introduced into reactor R1*c* with the feed; and
- a sixth period during which the feed successively traverses the reactor R1*a* then reactor R1*b* and in which the gas oil fraction from atmospheric distillation which is recycled is introduced into reactor R1*a* with the feed.

In the case shown in this FIG. 3 the process functions in a manner equivalent to that described with respect to FIGS. 1 and 2. During the first period, valves 31, 34, 44 and 48 are open and valves 32, 33, 35, 36 and 41 are closed. During the second period, valves 32, 44 and 48 are open and valves 31, 33, 34, 35, 36 and 41 are closed. During the third period, valves 32, 33, 35 and 44 are open and valves 31, 34, 36, 41 and 48 are closed. During the fourth period, valves 33, 35 and 41 are open and valves 31, 32, 34, 36, 44 and 48 are closed. During the fifth step, valves 33, 34, 36 and 41 are open and valves 31, 32, 35, 44 and 48 are closed. During the sixth step, valves 31, 34 and 36 are open and valves 32, 33, 35, 41, 44 and 48 are closed.

In one advantageous implementation, the unit comprises a conditioning section 30, not shown in the Figures, provided with circulation means, heating means, cooling means and suitable separation means functioning independently of the reaction section, whereby with the aid of lines and valves, the operations of preparing fresh catalyst contained in the guard reactor during permutation just before being connected, with the unit in operation, in place of the most upstream guard reactor, can be carried out namely: preheating the guard reactor during permutation, sulphurising the catalyst it contains, and bringing it to the conditions of pressure and temperature required for permutation. When the permutation operation of this guard reactor has been carried out using a set of suitable valves, this same section 30 can also carry out the operations of conditioning the used catalyst contained in the guard reactor just after disconnection of the reaction section, namely: washing and stripping the used catalyst under the required conditions, then cooling before proceeding to the operations of discharging this used catalyst then replacing it with fresh catalyst.

Preferably, the catalysts in the guard reactors are the same as those in hydrodemetallisation reactors 14 and 16.

Preferably again, these catalysts are those described in the Applicant's patents EP-B-0 098 764 and the French patent filed with national registration number 97/07149. They contain a support and 0.1% to 30% by weight, expressed as the metal oxides, of at least one metal or compound of a metal of at least one of groups V, VI and VIII of the periodic table and in the form of a plurality ofjuxtaposed agglomerates each formed from a plurality of acicular platelets, the platelets of each agglomerate generally being radially orientated with respect to each other and with respect to the centre of the agglomerate.

More particularly, the present invention relates to the treatment of heavy gasolines or heavy gasoline fractions, with a high asphaltene content, with the aim of converting them to lighter fractions, which are easier to transport or treat by the usual refining processes. Oils from coal hydrogenation can also be treated.

More particularly, the invention solves the problem of transforming a non transportable viscous heavy oil, which is rich in metals, sulphur and asphaltenes, and containing more than 50% of constituents with a normal boiling point of more than 520° C. to a stable hydrocarbon-containing product which can easily be transported, and having a reduced metals and asphaltenes content and a reduced content, for example less than 20% by weight, of constituents with a normal boiling point of more than 520° C.

In a particular implementation, before sending the feed to the guard reactors, it is first mixed with hydrogen and subjected to hydrovisbreaking conditions.

In a further implementation, the atmospheric residue or vacuum residue can undergo deasphalting using a solvent, for example a hydrocarbon-containing solvent or a solvent mixture. The most frequently used hydrocarbon-containing solvent is a paraffinic, olefinic or alicyclic hydrocarbon (or hydrocarbon mixture) containing 3 to 7 carbon atoms. This treatment is generally carried out under conditions which can produce a deasphalted product containing less than 0.05% by weight of asphaltenes precipitated by heptane in accordance with the standard AFNOR NF T 60115. This deasphalting can be carried out using the procedure described in the Applicant's patent U.S. Pat. No. 4,715,946. The solvent/feed volume ratio will usually be about 3:1 to about 4:1 and the elementary physico-chemical operations which compose the overall deasphalting operation (mixture-precipitation, decanting the asphaltene phase, washing-precipitation of the asphaltene phase) will usually be carried out separately. The deasphalted product is then normally at least partially recycled to the inlet to the first functioning guard zone.

Normally the solvent for washing the asphaltene phase is the same as that used for precipitation.

The mixture between the feed to be deasphalted and deasphalting solvent is usually carried out upstream of the exchanger which adjusts the temperature of the mixture to a value required to carry out proper precipitation and good decantation.

The feed-solvent mixture preferably passes into the tubes of the exchanger and not on the shell side.

The residence time of the feed-solvent mixture in the mixture precipitation zone is generally about 5 seconds (s) to about 5 minutes (min), preferably about 20 s to about 2 min.

The residence time for the mixture in the decanting zone is normally about 4 min to about 20 mm.

The residence time for the mixture in the washing zone generally remains between about 4 min and about 20 min.

The rate of rise of the mixtures both in the decanting zone and in the washing zone are usually less than about 1 cm per second (cm/s), preferably less than about 0.5 cm/s.

The temperature applied in the washing zone is usually less than that applied in the decanting zone. The temperature difference between these two zones will normally be about 5° C. to about 50° C.

The mixture from the washing zone will usually be recycled in the decanter and advantageously upstream of the exchanger located at the inlet to the decanting zone.

The solvent/asphaltene ratio recommended in the washing zone is about 0.5:1 to about 8:1 and preferably about 1:1 to about 5:1.

Deasphalting can comprise two stages, each stage including the three elementary phases of precipitation, decanting and washing. In this precise case, the temperature recommended in each phase of the first stage is preferably on average less than about 10° C. to about 40° C. at the temperature of each phase corresponding to the second stage.

The solvents which are used can also be C1 to C6 phenol, glycol or alcohol type solvents. However, paraffinic and/or olefinic solvents containing 3 to 6 carbon atoms are highly advantageously used.

The following examples illustrate the invention without limiting its scope. Example 1 is a comparison in which no gas oil is introduced with the feed. Example 2, in accordance with the invention, shows the surprising improvement in the quality of the gas oil obtained when the feed is mixed with gas oil before introducing it into the first reactor. The aim of these examples is to show the improvement in the quality of the gas oil obtained and the improvement in the ease of operation by reducing the viscosity of the effluent which will be highly favourable to reducing the pressure drops in the industrial reactor.

EXAMPLE 1

(Comparative)

The feed to be treated was a heavy vacuum residue (VR) of Arabian Light origin. Its characteristics are shown in Table 1, column 1.

This vacuum residue was treated in a catalytic hydrotreatment section. The unit used was a pilot unit simulating the function of an industrial HYVAHL® unit. This pilot unit comprised three reactors in series, each of 7 liters, operating in downflow mode. The product obtained at the outlet from the third reactor was then fractionated in line in an atmospheric distillation column from the bottom of which an atmospheric residue (AR) and a gas oil cut (GO) overhead. The reactors were charged, the first with 6.6 l of a catalyst containing, on an alumina support, 2.5% by weight of nickel oxide and 12% by weight of molybdenum oxide sold by Procatalyse with reference HMC841, the second with 3 l of this same catalyst HMC841 and the third with 7 l of a catalyst containing an alumina support with 3% by weight of cobalt oxide and 14% by weight of molybdenum oxide sold by Procatalyse with reference HT308. These catalysts were charged into the fixed beds of each reactor.

The operating conditions were as follows:

HSV=0.123h$^{-1}$ (overall)

P=150 bar (total)

Hydrogen recycle=1000 l. $H_2$/1 feed

Temperature=380° C. (in each of the reactors)

The characteristics of the products obtained are shown in Table 1. The total liquid effluent (C5+) is mentioned in column 2, the atmospheric gas oil in column 3 and the hydrotreated atmospheric residue in column 4.

EXAMPLE 2

This time, the same heavy vacuum residue of Arabian Light origin as above was treated but to which 14% by weight of atmospheric gas oil from hydroconversion of the same residue as in Example 1 was added.

The characteristics of the total feed (VR+ hydroconversion gas oil) introduced into the first reactor of the pilot unit are shown in column 1 of Table 2.

This vacuum residue was treated in a catalytic hydrotreatment section. The unit used was the same as that in Example 1 with the same catalytic system.

The operating conditions were the same as above apart from the HSV. In this case it was 0.143 h$^{-1}$ rather than 0.125 h$^{-1}$. The VR flow rate was the same as for Example 1, but a hydroconverted gas oil flow rate of 14% of the VR flow rate was also added.

The characteristics of the products obtained are shown in Table 2. The total liquid effluent (C5+) is mentioned in column 2, the atmospheric gas oil in column 3 and the hydrotreated atmospheric residue in column 4.

The hydrotreated residue had exactly similar characteristics to those of Example 1. The fact of adding gas oil to the fresh (VR) feed, while retaining the same VR flow rate, did not degrade the quality of the hydrotreated residue.

Above all, two important advantages can be seen:

The sulphur content of the gas oil produced was better: it was 0.08% in Example 1 while here it was only 0.03%: this product thus directly satisfied current sulphur specifications for diesel engines.

The viscosity of the total liquid effluent which was 40 cSt at 100° C. in the case of Example 1 was no more than 19 cSt at 100° C. This reduction in viscosity was highly favourable to the reduction of pressure drops in the industrial reactor.

TABLE 1

Qualities of feed and products

| | 1 | 2 | 3 | 4 |
|---|---|---|---|---|
| Cut | VR Arabian Light | C5 + ex Hyvahl | GO ex Hyvahl | AR ex Hyvahl |
| Density 15/4 | 1.014 | 0.947 | 0.841 | 0.960 |
| Sulphur, % by weight | 4.14 | | 0.08 | 0.5 |
| Conradson carbon, % by weight | 19.8 | | | 8 |
| C7 asphaltenes, % by weight | 6.3 | | | 1 |
| Ni + V, ppm | 95 | | | 9 |
| Viscosity at 100° C. (cSt) | 650 | 40 | | |

TABLE 2

| | Qualities of feed and products | | | |
|---|---|---|---|---|
| | 1 | 2 | 3 | 4 |
| Cut | VR Arabian Light + GO ex Hyvahl | C5 + ex Hyvahl | GO ex Hyvahl | AR ex Hyvahl |
| Density 15/4 | 0.996 | 0.935 | 0.841 | 0.960 |
| Sulphur, % by weight | 3.61 | | 0.03 | 0.5 |
| Conradson carbon, % by weight | 17.4 | | | 8.3 |
| C7 asphaltenes, % by weight | 5.5 | | | 1 |
| Ni + V, ppm | 83 | | | 9 |
| Viscosity at 100° C. (cSt) | 167 | 19 | | |

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 98/12.913, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for hydrotreating a heavy hydrocarbon fraction containing asphaltenes, sulphur-containing impurities and metallic impurities in at least two steps, comprising during the first step, hydrodemetallisation, passing the heavy hydrocarbon fraction and hydrogen over a hydrodemetallisation catalyst under hydrodemetallisation conditions, and during the subsequent second step, passing resultant effluent from the first step over a hydrodesulphurisation catalyst under hydrodesulphurisation conditions, in which the hydrodemetallisation step comprises one or more hydrodemetallisation zone with fixed catalyst beds preceded by at least two hydrodemetallisation guard zones also with fixed catalyst beds, disposed in series for cyclic use comprising successive repetition of steps b) and c) defined below:

a) a step comprising passing the heavy hydrocarbon fraction through all the guard zones for a period of at most equal to the deactivation time and/or clogging time for one thereof;

b) a step during which the deactivated and/or clogged guard zone is short-circuited and the catalyst the short circuited guard zone contains is regenerated and/or replaced by fresh catalyst; and c) a step during which the guard zones are all used together, the guard zone where the catalyst has been regenerated and/or replaced by fresh catalyst during the preceding step, being reconnected, and said step being carried out for a period at most equal to the deactivation and/or clogging time for one of the guard zones;

said process being characterized in that a quantity of gas oil representing 0.5% to 80% by weight with respect to the weight of the hydrocarbon feed is introduced into the inlet to the first functioning guard zone at the same time as the feed; and said process further comprises passing product from the hydrodesulphurisation to an atmospheric distillation zone, from which an atmospheric distillate is recovered and recycling at least a portion of said atmospheric distillate comprising a gas oil to the inlet of the first functioning guard zone and recovering an atmospheric residue.

2. A process according to claim 1, in which a portion of the gas oil is a straight run gas oil.

3. A process according to claim 2, in which the straight gas oil fraction is a cut with an initial boiling point of about 150° C. and an end point of about 370° C.

4. A process according to claim 1, in which the quantity of gas oil introduced into the inlet to the first functioning guard zone at the same time as the feed represents about 1% to 50% by weight with respect to the feed.

5. A process according to claim 1, in which at least a portion of the atmospheric residue from the atmospheric distillation zone is sent to a vacuum distillation zone from which a vacuum distillate is recovered at least a portion of which is recycled to the inlet to the first functioning guard zone, and a vacuum residue is also recovered.

6. A process according to claim 5, further comprising deasphalting the vacuum residue using a solvent or a solvent mixture and recycling at least a portion of the deasphalted product to the inlet to the first functioning guard zone.

7. A process according to claim 5, in which, in order to treat a feed constituted by a heavy oil or a fraction of a heavy oil containing asphaltenes, the feed is first mixed with hydrogen and subjected to hydrovisbreaking before sending the feed to the guard zones.

8. A process according to claim 1, in which at least a portion of the atmospheric residue and/or a vacuum distillate is sent to a catalytic cracking unit from which an LCO fraction and an HCO fraction are recovered, at least a portion of either one or the other or a mixture of the two is went to the inlet to the first functioning guard zone.

9. A process according to claim 8, in which, in order to treat a feed constituted by a heavy oil or a fraction of a heavy oil containing asphaltenes, the feed is first mixed with hydrogen and subjected to hydrovisbreaking before sending the feed to the guard zones.

10. A process according to claim 1 in which during step c) the guard zones are all used together, the guard zone in which the catalyst has been regenerated and/or replaced during step b) being reconnected such that its connection is identical to that which it had before it was short-circuited during step b).

11. A process according to claim 1 comprising the following steps:

a) a step in which the guard zones are used all together for a period at least equal to the deactivation and/or clogging time of the most upstream guard zone with respect to the overall direction of circulation of the treated feed;

b) a step during which the feed penetrates directly into the guard zone located immediately after that which was the most upstream during the preceding step and during which the guard zone which was the most upstream during the preceding step is short-circuited and the catalyst it contains is regenerated and/or replaced by fresh catalyst; and c) a step during which the guard zones are used all together, the guard zone in which the catalyst has been regenerated and/or replaced during the preceding step being reconnected so as to be downstream of the set of guard zones and said step being continued for a period at most equal to the deactivation and/or clogging time of the guard zone which during this step is the most upstream with respect to the overall direction of circulation of the treated feed.

12. A process according to claim 1, in which a conditioning section is associated with the guard zones to allow permutation of the guard zones during operation, without stopping the unit, said section being adjusted so as to condition the catalyst contained in the guard zone which is not operating, to a pressure in the range 10 to 50 bars.

13. A process according to claim 1 in which, in order to treat a feed constituted by a heavy oil or a fraction of a heavy oil containing asphaltenes, the feed is first mixed with hydrogen and subjected to hydrovisbreaking, before sending the feed to the guard zones.

14. A process according to claim 1, further comprising deasphalting the atmospheric residue using a solvent or a solvent mixture and recycling at least a portion of the deasphalted product to the inlet to the first functioning guard zone.

15. A process for hydrotreating a heavy hydrocarbon fraction containing asphaltenes, sulphur-containing impurities and metallic impurities in at least two steps, comprising during the first step, hydrodemetallisation, passing the heavy hydrocarbon fraction and hydrogen over a hydrodemetallisation catalyst under hydrodemetallisation conditions, and during the subsequent second step, passing resultant effluent from the first step over a hydrodesulphurisation catalyst under hydrodesulphurisation conditions, in which the hydrodemetallisation step comprises one or more hydrodemetallisation zone with fixed catalyst beds preceded by at least two hydrodemetallisation guard zones also with fixed catalyst beds, disposed in series for cyclic use comprising successive repetition of steps b) and c) defined below:

a) a step comprising passing the heavy hydrocarbon fraction through all the guard zones for a period of at most equal to the deactivation time and/or clogging time for one thereof;

b) a step during which the deactivated and/or clogged guard zone is short-circuited and the catalyst the short circuited guard zone contains is regenerated and/or replaced by fresh catalyst; and c) a step during which the guard zones are all used together, the guard zone where the catalyst has been regenerated and/or replaced by fresh catalyst during the preceding step, being reconnected, and said step being carried out for a period at most equal to the deactivation and/or clogging time for one of the guard zones;

said process being characterized in that a quantity of gas oil representing 0.5% to 80% by weight with respect to the weight of the hydrocarbon feed is introduced into the inlet to the first functioning guard zone at the same time as the feed; and said process further comprises passing product from the hydrodesulphurisation to a distillation zone, from which a distillate is recovered and recycling at least a portion of said distillate comprising a gas oil to the inlet of the first functioning guard zone and recovering a residue.

* * * * *